US008894377B2

(12) United States Patent
Greenberg

(10) Patent No.: US 8,894,377 B2
(45) Date of Patent: Nov. 25, 2014

(54) FOLDING PERSONAL FAN

(76) Inventor: Jeffrey Alan Greenberg, Princeton, WV (US)

( * ) Notice: Subject to any disclaimer, the term of this patent is extended or adjusted under 35 U.S.C. 154(b) by 411 days.

(21) Appl. No.: 13/267,280

(22) Filed: Oct. 6, 2011

(65) Prior Publication Data

US 2012/0087812 A1 Apr. 12, 2012

Related U.S. Application Data

(60) Provisional application No. 61/344,787, filed on Oct. 6, 2010.

(51) Int. Cl.
*F04D 29/00* (2006.01)
*F04D 25/08* (2006.01)
*F04D 29/64* (2006.01)

(52) U.S. Cl.
CPC ..... *F04D 25/08* (2013.01); *F04D 29/646* (2013.01)
USPC ..... 416/247 R; 415/121.2; 415/126; 415/127; 415/142; 417/423.14

(58) Field of Classification Search
USPC ..... 416/142, 143, 148, 247 R, 246; 417/423.14; 415/121.2, 126–128
See application file for complete search history.

(56) References Cited

U.S. PATENT DOCUMENTS

| | | | | | |
|---|---|---|---|---|---|
| 1,868,113 | A * | 7/1932 | Ljungstrom | 416/143 |
| 2,079,942 | A * | 5/1937 | Le Velle | 416/87 |
| 2,100,923 | A * | 11/1937 | Schmidt et al. | 416/246 |
| 2,654,533 | A * | 10/1953 | Collins | 416/247 R |
| 2,745,598 | A * | 5/1956 | Martinez | 416/143 |
| 2,750,104 | A * | 6/1956 | Scaroulis | 416/143 |
| 2,811,305 | A * | 10/1957 | Scaroulis | 416/143 |
| 5,498,134 | A * | 3/1996 | Ibekwe | 416/142 |
| 7,878,424 | B2 * | 2/2011 | Schnuckle | 239/289 |
| 2010/0202882 | A1 * | 8/2010 | Liu | 416/88 |

* cited by examiner

*Primary Examiner* — Charles Freay
*Assistant Examiner* — Christopher Bobish
(74) *Attorney, Agent, or Firm* — Clifford Kraft

(57) ABSTRACT

A personal motorized cooling fan designed to retract and fold into a vertical tower for economy of shipping, storage and desk space. Each fan blade includes a blade portion and a root portion that rides in a race that guides the blades as they splay during rotation. When the fan is turned on, the rotation of the shaft and therefore race, combined with centrifugal force, causes the blades to splay forming a radial array. A protective cage including an array of longitudinal members expands in a fan-like manner. The cage is engaged with ribbons of stretch fabric that retract and fold along with the cage and blades after use. The entire assembly folds tidily into a slender tower.

9 Claims, 6 Drawing Sheets

100

FOLDING PERSONAL FAN

This application is related to and claims priority from U.S. Provisional Patent Application No. 61/344,787 file Oct. 6, 2010. Application 61/344,787 is hereby incorporated by reference.

BACKGROUND

1. Field of the Invention

The present invention relates generally to cooling fans and more particularly to a folding personal fan.

2. Description of the Prior Art

Prior art products are available for personal cooling including standing fans, hand-held fans, desk-top fans and the like. Some of these products are electric, while others are manual. Such a fan is shown in U.S. Design Patent no. D367,320. There have been a few fans that fold in various ways. These can be seen in U.S. Pat. No. 1,577,502, U.S. Pat. No. 2,079,942 and more recently in U.S. published application 2011/0129365.

SUMMARY OF THE INVENTION

The present invention relates to a small personal cooling fan including fan blades and a protective cage surrounding the blades both designed to automatically retract and fold into a vertical tower when the fan is turned-off for economy of shipping, storage and desk space and to automatically deploy when the fan is turned-on. From the closed or retracted position, a protective cage, that includes an array of longitudinal members can automatically expand in a fan-like manner to provide protection and safety from the rotating blades.

In a particular embodiment, the longitudinal members form a 'U' shape and surround the area in which the fan blades rotate. The longitudinal members lock open and into place via a snap-fit groove in the center of the array. The cage is interconnected with ribbons of stretch fabric that expand to form a protective cage around the rotating fan blades and retract and fold along with the cage and blades. Each fan blade includes a blade portion and a root portion that rides in a race. The race guides the blades as they splay during rotation. When the fan is turned on, the rotation of the shaft and therefore the race, combined with centrifugal force, causes the blades to splay, forming a radial array.

DESCRIPTION OF THE FIGURES

For a more complete understanding of the components, processes, and apparatuses disclosed herein reference is made to the accompanying figures. These figures are intended to illustrate the teachings taught herein and are not intended to show relative sizes and dimensions, or to limit the scope of examples or embodiments. In the drawings, the same numbers are used throughout the drawings to reference like features and components of like function.

Several drawings and illustrations have been presented to aid in understanding the present invention. The scope of the present invention is not limited to what is shown in the figures.

DETAILED DESCRIPTION OF THE PREFERRED EMBODIMENT

Figure 1:
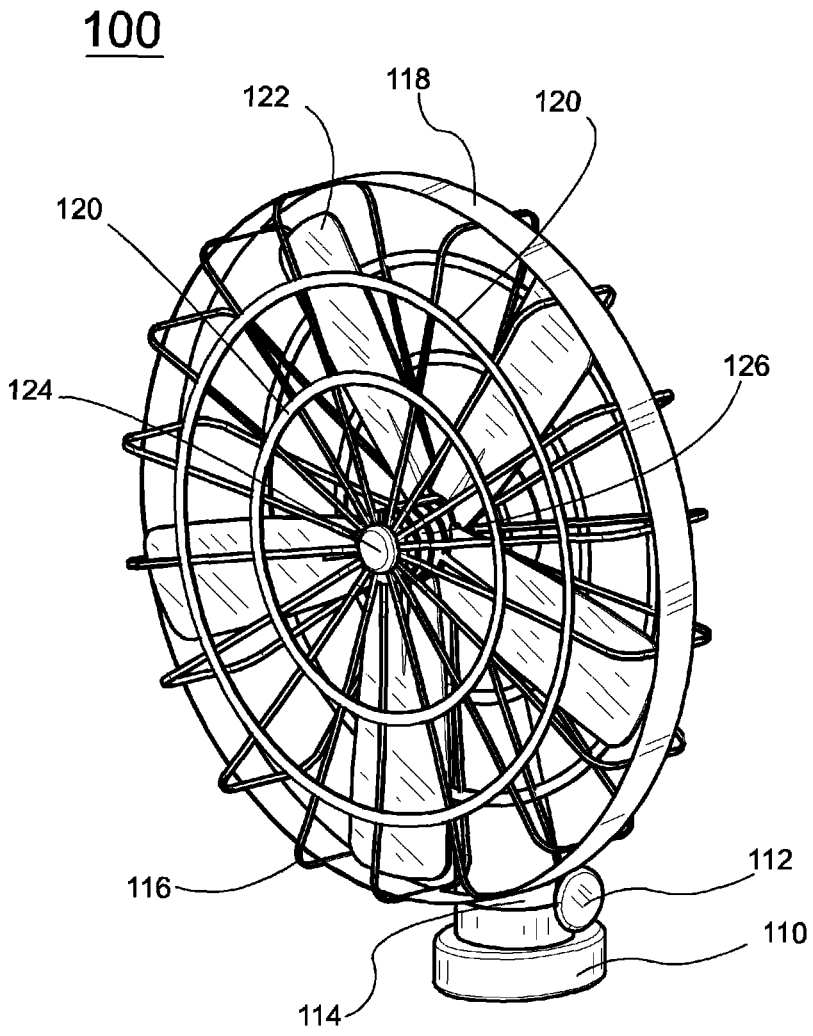
FIG. 1 is a right-front perspective view of an embodiment of the present disclosure in the open configuration.

The present invention relates to personal fans for ventilation and cooling, in particular a personal electric fan with folding blades. FIG. 1 depicts an example embodiment in an expanded configuration. The fan comprises a base 110 engaged with a hinge 112 that is in turn engaged with a tower, otherwise known as a support structure 114. The tower provides a housing for a motor and appropriate electronics to control the rotation of the fan blades 122. An array of fan blades 122 are engaged with a shaft 126. A protective cage surrounds the area in which the blades rotate and includes longitudinal members 116. In the preferred embodiment, the longitudinal members 116 form an elongated 'U' shape to sufficiently surround the rotating blades. Elastic fabric members 120 form rings about the vertical surfaces of the cage that is formed by the longitudinal members 116. A radial elastic member 118 is engaged with the ends of the 'U' shaped longitudinal members 116. A cap 124 is engaged with the central shaft and provides a means by which the longitudinal members 116 snap into place when arrayed.

Figure 2:
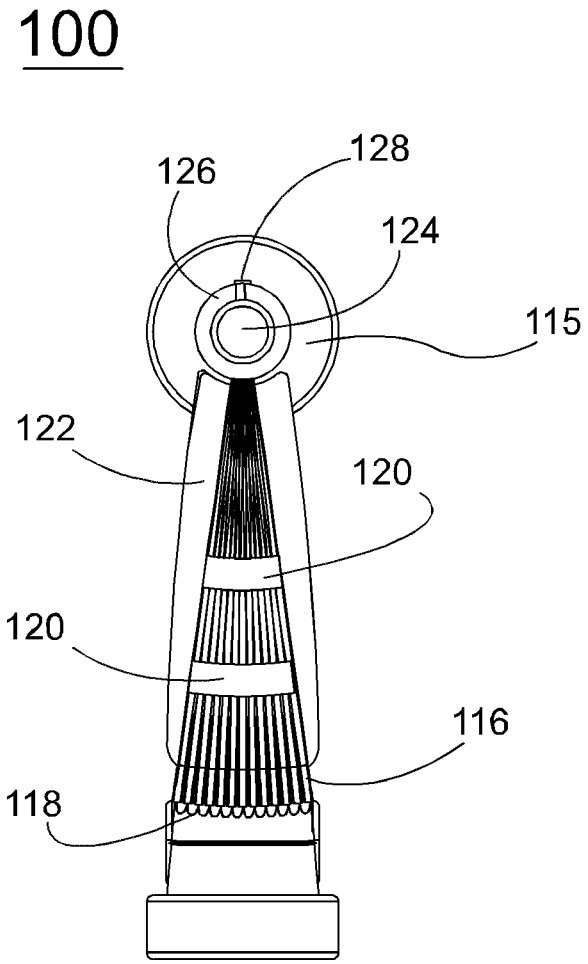
FIG. 2 is a front, orthographic view of the embodiment of FIG. 1.
Figure 3:
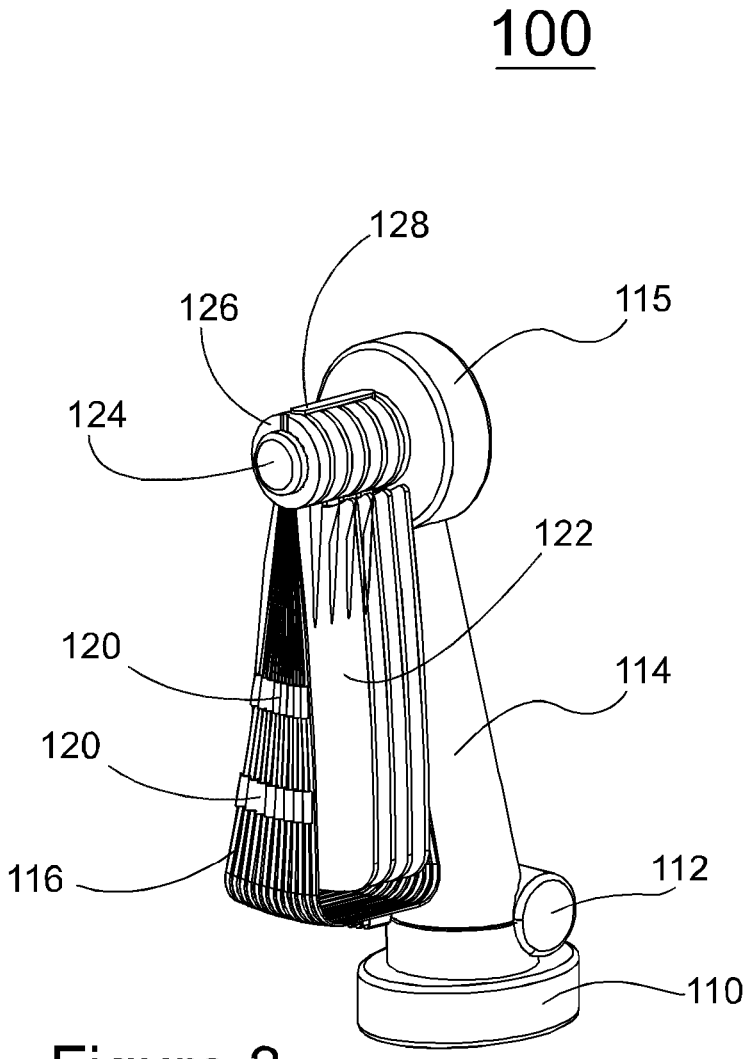
FIG. 3 is a right-front perspective view of the device of FIG. 1 in the collapsed configuration.

Referring to FIGS. 2-3, FIG. 2 is an orthographic front view of the embodiment 100 in a collapsed configuration. FIG. 3 is a front-perspective view of the embodiment 100 in a collapsed configuration. Elastic member 118 (FIG. 2) is engaged with the ends of the 'U' shaped longitudinal members 116 and is furled. Elastic rings 120 are engaged with the collapsed longitudinal members 116 and are similarly furled. Fan blades 122 hang by gravitational force in a downward position when the fan is off as illustrated. The upper portion 115 of the tower 114 (FIG. 1) houses a motor that is attached to the central shaft 126 which is in turn laterally and spring-like engaged with the cap 124. An interference device 128 engages the central shaft 126 to retain the blades 122 on the central shaft.

Figure 4:
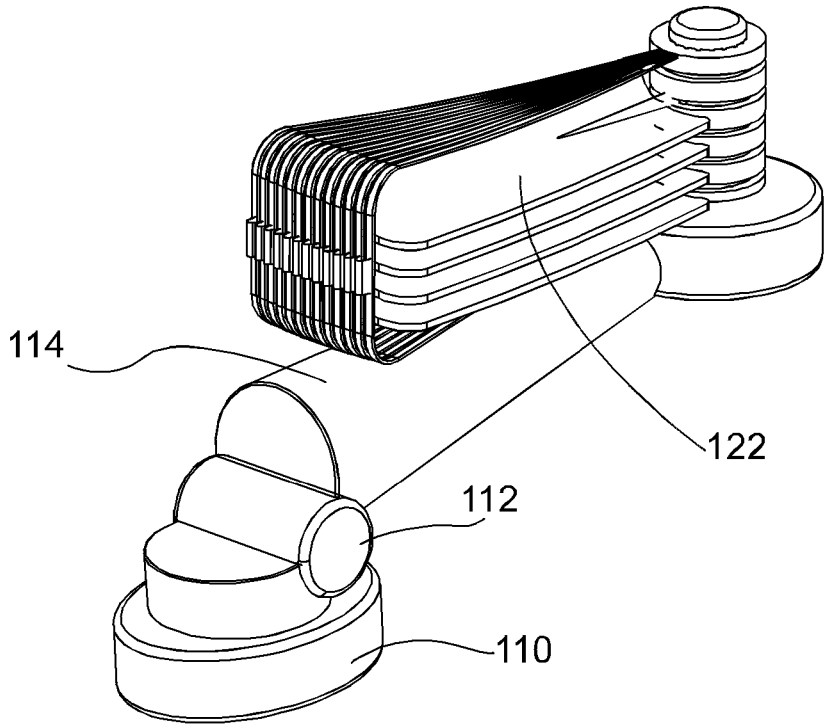
FIG. 4 is a right-front perspective view of the device of FIG. 1 in a configuration with the tower folded down.

Referring to FIG. 4, a perspective view of the embodiment 100 is shown in the collapsed position with the tower section 114 rotated downwards about the hinge 112 with respect to the base 110.

Figure 5:
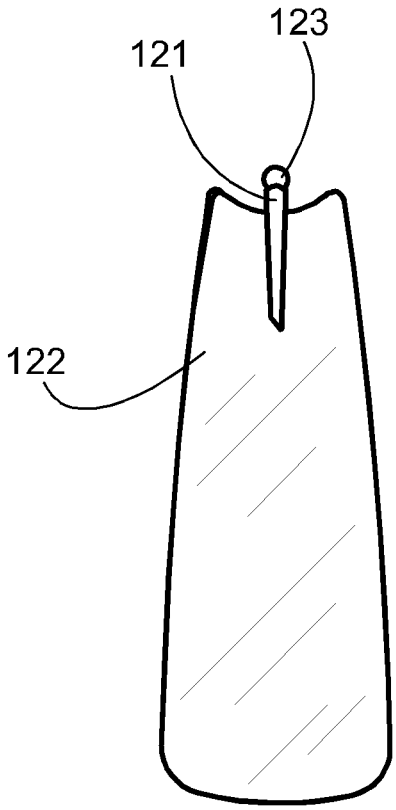
FIG. 5 is a front, orthographic view of a fan blade of the device of FIG. 1.

Referring to FIG. 5, an orthographic front view of the fan blade of the embodiment 100 is shown. The blade comprises a blade portion 122 engaged with a root shaft 121 that is in turn engaged with a protrusion 123.

Figure 6:
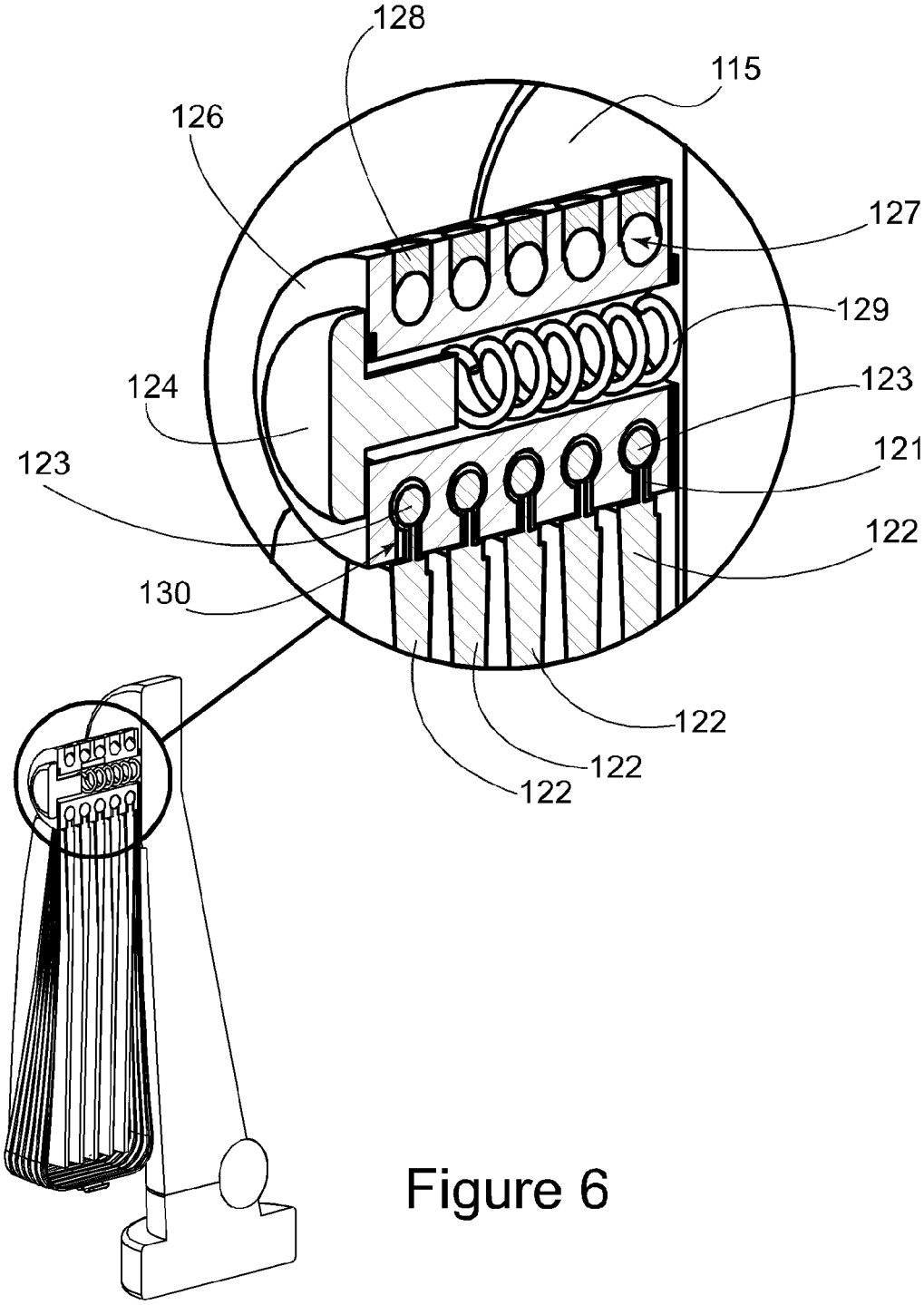
FIG. 6 is a right-front, detailed, section, perspective view of an embodiment showing the fan blade race.

Referring to FIG. 6, a detailed view of the central shaft 126 and the engagement with the blades 122 is shown. The central shaft includes an array of race channels 127 that provide a guide for protrusions 123 that are engaged with root shafts 121 that are in turn engaged with the blades 122. An array of slots 130 provide a channel for the root shafts 121 to move through radially. Protrusions 123 ride in the race 127 and self-balance to form a radial array when the central shaft 126 is rotated by the motor (not shown). An interference device 128 cooperates with the central shaft 126. In order to assemble the blades on the central shaft, the blade root portion including root shaft 121 and protrusion 123 are inserted onto the central shaft 126 and the holes into which the blade root-shafts and protrusions are inserted are covered with the interference device 128 to prevent the blades from exiting the central shaft during rotation.

A cap 124 is laterally engaged with the central shaft 126 in such a manner as to hold the longitudinal members (not shown for clarity) in a clamped fashion when arrayed in the open configuration. The cap 124 is held with a tension spring 129 that is fixedly engages the central shaft 126 such that the cap 124 may move laterally, but is held under spring tension by the spring 129 such that it may clamp the longitudinal members into place in an array as illustrated in FIG. 1.

The present disclosure has been described with reference to exemplary embodiments. A person with skill in the art will realize that numerous changes and modifications can be made without departing from the spirit of the invention. Each of these changes and modifications is within the scope of the present invention.

I claim:

1. A personal fan device that automatically folds into a compact tower when not in use and automatically deploys when turned-on comprising:

a base;

an elongated tower attached to said base supporting a motor having a shaft, the shaft including a plurality of shaft races;

an array of fan blades engaging the shaft, said shaft having at least one race for each blade; wherein each blade includes a central and distal blade portion that is curved to move air when said blade is in motion and a proximal portion that is adapted to function as a blade-root guide;

wherein each blade-root guide engages a corresponding shaft-race such that the blades splay into an array when the fan is activated;

a plurality of U-shaped longitudinal members that form a collapsible cage sufficient to surround the blades when the fan is in use;

each longitudinal member engaging a cap that cooperates with the shaft to allow the longitudinal members to be snapped into place forming the cage for protection when the fan is activated; the longitudinal members collapsible by rotating around the shaft to a vertical stacked configuration when the fan is deactivated;

the cap being laterally engaged with the shaft and adapted to hold the longitudinal members in a clamped configuration when the fan is in use, the cap being held with a spring attached to the shaft such that the cap may move laterally, but is held under spring tension in order to clamp the longitudinal members into a cage when the fan is in use.

2. The personal fan device of claim 1 wherein the tower includes a hinge allowing it to fold approximately ninety degrees with respect to the base.

3. The personal fan device of claim 1 further comprising at least one elastic ring engaged with said longitudinal members, the elastic ring forming an approximate circle on a front side of the cage when the cage is deployed, and being furled when the cage is folded.

4. The personal fan device of claim 3 further comprising two concentric elastic rings.

5. The personal fan device of claim 1 further comprising an elastic member configured to circle the circumference of the collapsible cage when the cage is deployed and to be furled when the cage is folded.

6. A collapsible fan comprising:

a tower supporting an electric motor having a shaft, the shaft extending forward of the motor; the tower attached to a base; the tower having a hinge proximate to the base allowing the tower to rotate through an angle of approximately ninety degrees with respect to the base;

a plurality of fan blades attached to the shaft, the fan blades configured to all hang vertically when the fan is off, and to splay outward into an array configuration by centrifugal force when the fan is on;

a collapsible cage comprising a plurality of rod members adapted to rotate axially about the shaft and to hang in a folded configuration when the fan is off and to be deployed into a circular safety cage configuration when the fan is to be activated by rotating them axially about the shaft, the rod members engaging a spring-biased cap proximate to the shaft that snaps and holds the rod members in the cage configuration;

a pair of elastic rings configured to circle a front surface of the safety cage in the cage configuration and to be furled in the folded configuration;

a third elastic ring configured to circle the circumference of the cage in the cage configuration and to be furled in the folded configuration.

7. A collapsible fan comprising:

a tower supporting an electric motor having a shaft, the shaft extending forward of the motor;

a plurality of fan blades attached to the shaft, the fan blades configured to all hang vertically when the fan is off, and to splay outward into an array configuration by centrifugal force when the fan is on;

a collapsible cage comprising a plurality of rod members adapted to rotate axially about the shaft and to hang in a folded configuration when the fan is off and to be deployed into a circular safety cage configuration when the fan is to be activated by rotating them axially about the shaft, the rod members engaging a spring-biased cap proximate to the shaft that snaps and holds the rod members in the cage configuration;

a pair of elastic rings configured to circle a front surface of the safety cage in the cage configuration and to be furled in the folded configuration.

8. The collapsible fan of claim 7 further comprising a third elastic ring configured to circle the circumference of the cage in the cage configuration and to be furled in the folded configuration.

9. The collapsible fan of claim 7 further comprising a hinge proximate to the base allowing the tower to rotate through an angle of approximately ninety degrees with respect to the base.

* * * * *